US007816595B1

(12) United States Patent
Dietrich

(10) Patent No.: US 7,816,595 B1
(45) Date of Patent: Oct. 19, 2010

(54) METHODS OF CONSTRUCTING AND TUNING OCARINAS

(76) Inventor: Jordan Reder Dietrich, 4973 Havana Dr., Pittsburgh, PA (US) 15239

( * ) Notice: Subject to any disclaimer, the term of this patent is extended or adjusted under 35 U.S.C. 154(b) by 0 days.

(21) Appl. No.: 12/459,356

(22) Filed: Jun. 29, 2009

(51) Int. Cl.
*G10D 7/02* (2006.01)

(52) U.S. Cl. ..... 84/384; 84/380 R

(58) Field of Classification Search ..... 84/380 R, 84/384
See application file for complete search history.

(56) References Cited

U.S. PATENT DOCUMENTS

| | | | | | |
|---|---|---|---|---|---|
| D20,998 | S | * | 8/1891 | Litzelle | D17/10 |
| 1,788,613 | A | * | 1/1931 | Bernard | 84/384 |
| D112,623 | S | * | 12/1938 | Swanson | D17/10 |
| 2,145,605 | A | * | 1/1939 | Mausolf | 84/380 R |
| 2,194,332 | A | * | 3/1940 | Sumner | 84/380 R |
| 2,195,992 | A | * | 4/1940 | Mausolf | 84/380 R |
| 2,214,553 | A | * | 9/1940 | Gruber | 84/380 C |
| 2,331,975 | A | * | 10/1943 | Hagopian | 84/330 |
| 2,460,931 | A | * | 2/1949 | Gretsch | 84/380 C |
| 2,478,323 | A | * | 8/1949 | Rohner | 84/380 C |
| 2,485,749 | A | * | 10/1949 | Ladd | 84/384 |
| 2,610,538 | A | * | 9/1952 | Lederfine | 84/377 |
| 3,815,466 | A | * | 6/1974 | Johnson | 84/380 R |
| D258,364 | S | * | 2/1981 | Mumford | D17/10 |
| D272,159 | S | * | 1/1984 | del Rio | D17/10 |
| 4,893,541 | A | * | 1/1990 | Fowler et al. | 84/380 C |
| D306,454 | S | * | 3/1990 | Kanamori | D17/10 |
| D389,855 | S | * | 1/1998 | Druz | D17/10 |
| 6,348,647 | B1 | * | 2/2002 | Ahrens | 84/384 |
| 6,872,876 | B2 | * | 3/2005 | Ahrens | 84/380 R |
| 6,914,179 | B2 | * | 7/2005 | Ahrens | 84/384 |
| 2004/0244562 | A1 | * | 12/2004 | Ahrens | 84/380 R |
| 2007/0157792 | A1 | * | 7/2007 | Lee, II | 84/380 R |

FOREIGN PATENT DOCUMENTS

| | | | | |
|---|---|---|---|---|
| GB | 2227352 | A | * | 7/1990 |
| JP | 10222157 | A | * | 8/1998 |
| JP | 2006284996 | A | * | 10/2006 |
| JP | 2008152217 | A | * | 7/2008 |
| KR | 100654913 | B1 | | 11/2006 |
| KR | 100849581 | B1 | | 7/2008 |
| WO | WO 2006080728 | A1 | * | 8/2006 |
| WO | WO 2008013338 | A1 | * | 1/2008 |

OTHER PUBLICATIONS

STL Ocarina, 8 hole ocarina, with annotations, viewed Jan. 29, 2010 at http://stlocarina.com/8hole.html, for sale date of Jul. 2005 provided a request to http://blog.stlocarina.com/.*

STL Ocarina, 8 hole ocarina fingering, rendered Jun. 12, 2009, viewed Jan. 29, 2010 at http://blog.stlocarina.com/storage/fingering-charts/8hole.pdf.*

(Continued)

*Primary Examiner*—Jeffrey Donels
*Assistant Examiner*—Robert W Horn

(57) ABSTRACT

Improved methods for tuning ocarinas to extend their capabilities, musical ranges, and ease of use. Ocarinas having enhanced fingering patterns using subholes, split toneholes, additional tonehole(s), and/or an additional thumbhole. Enhancements to cross-fingered ocarinas with one or two chambers and linear-fingered ocarinas with two or more chambers.

10 Claims, 16 Drawing Sheets

OTHER PUBLICATIONS

STL Ocarina, double ocarina, with annotations, viewed Jan. 29, 2010 at http://stlocarina.com/12double2.html, for sale date of Jul. 2005 provided a request to http://blog.stlocarina.com/.*

STL Ocarina, double ocarina fingering chart © 2008 rendered Feb. 24, 2008, viewed Jan. 29, 2009 at http://blog.stlocarina.com/storage/fingering-charts/12doublel.PDF.*

STL Ocarina, triple ocarina, with annotations, viewed Jan. 29, 2010 at http://www.stlocarina.com/triple2.html for sale date of Jul. 2005 provided a request to http://blog.stlocarina.com/.*

Ocarina Fingering Chart, © 2001-2005, showing chart for 8-hole ocarina, viewed at http://www.greenverdugo.com/ocarina-making-tutorial/ocarina-making-fingering.html Jan. 29, 2009.*

STL Ocarina, triple ocarina, with annotations, viewed Jan. 29, 2010 at http://stlocarina.com/ocarina-by-type-10-hole.html for sale date of Jul. 2005 provided a request to http://blog.stlocarina.com/.*

The Clay Pot That Sings: The Ocarina of Time, Ray and Lee Dessy, Dec. 11, 2001, viewed Jan. 29, 2009 at http://www.recorderhomepage.net/ocarina.pdf. Originally published in American Recorder, Mar. 2001; http://ourworld.compuserve.com/homepages/recorder/.*

Mountain Ocarina 10-hole Ocarina, apparatus diagram and fingering chart, rendered into PDF Aug. 22, 2006, viewed Jan. 29, 2010 at http://www.mountainsocarina.com/docs/key-of-g.pdf.* http://stlocarina.com/6double1.html.

* cited by examiner

METHODS OF CONSTRUCTING AND TUNING OCARINAS

BACKGROUND OF THE INVENTION

CROSS-REFERENCE TO RELATED APPLICATIONS

Not Applicable

STATEMENT REGARDING FEDERALLY SPONSORED RESEARCH AND DEVELOPMENT

Not Applicable

1. Field of the Invention

The present invention relates to ocarinas and other vessel flutes.

2. Prior Art

Prized for their simplicity, portability, and pure tone, the musical instruments that developed into modern ocarinas have existed for ages. Since their earliest significant modern improvement, the utilization of a modern tuning in conjunction with a linear fingering pattern, the ocarina has been considered suitable for performing western music. Another notable improvement to the ocarina was the development of a four-hole tuning system, commonly called and hereinafter referred to as crossed-fingering. See, for example, U.S. Pat. No. 3,815,466. This tuning allows the user to perform the notes of a one octave major scale using only four tone holes. However, even with the addition of thumbholes, these ocarinas have been limited to the range of eleven notes of a major scale and cannot accurately perform all accidentals within the range. This inability to perform all accidentals was partially overcome by dividing the smallest tone hole into two substantially equal-sized holes, such holes hereinafter referred to as a split hole. This split hole functioned differently than subholes common on ocarinas with linear fingerings in that they are stopped together to function as one hole and using them does not lower the pitch below the tonic of the scale. Stopping only one of theses two holes would allow performance of one semitone above the tonic. However, one could still not accurately perform three semitones above the tonic. In U.S. Pat. Application Publication # US 2007/0157792 A1, the disclosure of which is incorporated herein by reference, is disclosed an ocarina that utilizes two subholes and an additional finger hole to allow a cross-fingered ocarina to perform all accidentals and a range of thirteen notes of a major scale. A subhole is a tonehole that is typically left open, but is stopped when the performer desires to play below the tonic note. However, this prior art mentions and depicts only an ocarina that utilizes subholes that specifically are adjacent to the first two standard toneholes. Since this requires the subholes to be operated with the same fingers that must also operate the adjacent toneholes, this arrangement would likely prove difficult for many performers.

Despite many improvements, the physical properties of ocarinas generally limit them to a range of thirteen notes of a major scale. That range was eventually expanded by adding a second chamber, making two ocarinas with differing fundamental pitches into one instrument. The range of a two-chambered ocarina has been limited to two octaves plus two notes. A two-chambered cross-fingered ocarina has been limited to a range of two octaves.

There is in existence two separate two chambered transverse ocarinas wherein the higher chamber utilizes a thumbhole. However, in both cases, the use of the thumbhole does not extend the range of the instrument beyond the common range, and the thumbhole does not raise the pitch more than one tone. The thumbholes of these ocarinas do nothing unexpected, as they function like any other tonehole.

While the addition of a third chamber has increased the range of ocarinas to one note less than three octaves, this has also increased costs of production, size, weight, and difficulty of use.

SUMMARY

The present invention includes ocarinas that have their musical ranges expanded by novel methods of construction and tuning. The present invention also includes ocarinas that permit more accurate performance of accidentals.

The present invention comprises ocarinas with one or more chambers utilizing an enhanced cross-fingering having subholes and/or split holes, and multi-chambered ocarinas having a higher chamber or chambers utilizing an enhanced linear fingering pattern. The present invention allows greater possibilities of musical expression to the performer and a lessened level of difficulty in performing.

A further advantage of the invention is that it enables a performer to use a single chamber of a cross-fingered ocarina to perform thirteen notes of a major scale, including all accidentals, in a simplified manner.

Advantages of multi-chamber ocarinas constructed according to the invention are that they utilize more fully the range of each chamber, which renders the use of a third chamber unnecessary to achieve a comparable note range. A further advantage of the invention is that it allows for the construction of ocarinas that are lighter, smaller, more portable, and less costly to produce than other ocarinas with comparable note ranges.

DRAWING FIGURES

DESCRIPTION

Figure 1A:
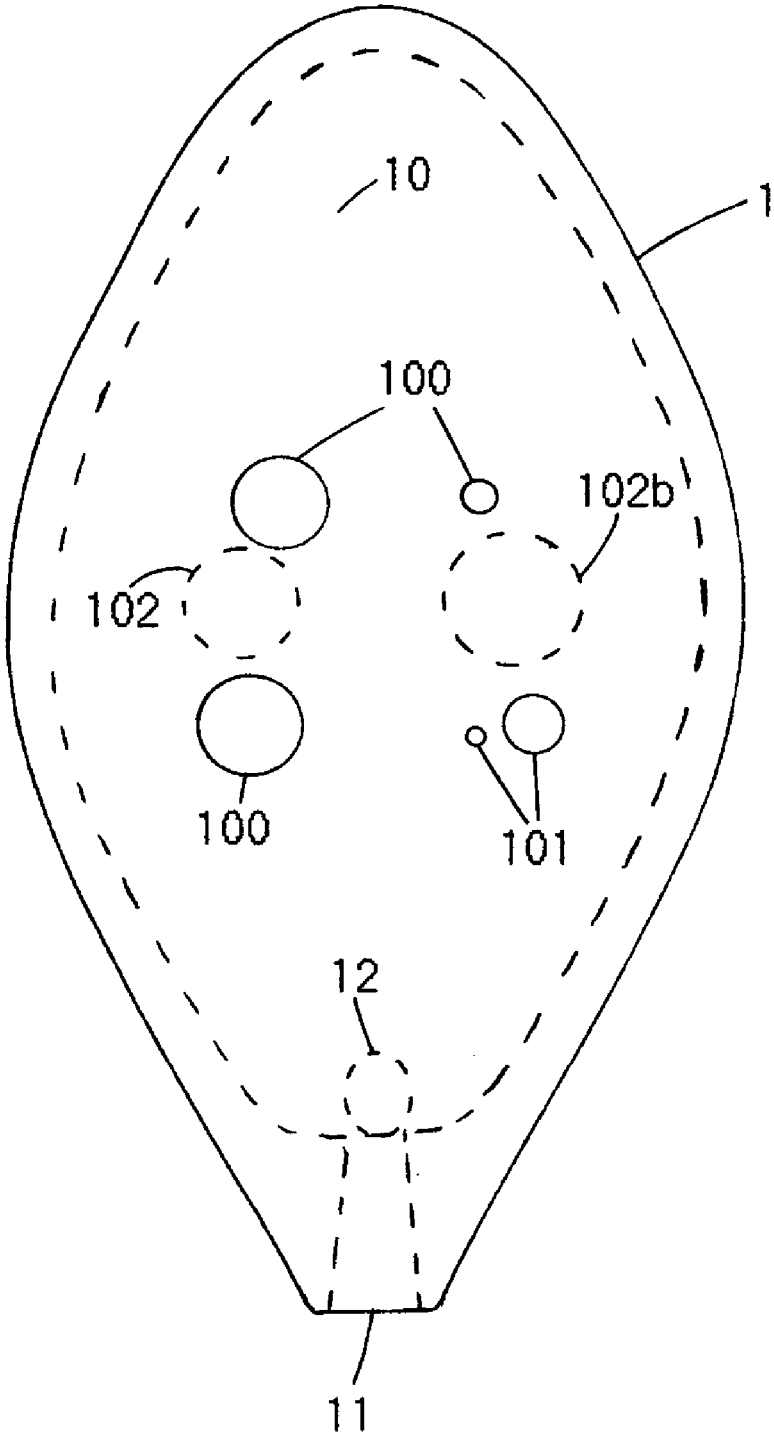
FIG. 1A is an elevation view of a cross-fingered ocarina according to the invention.

In order that the above-recited advantages and features of the invention may be thoroughly understood, a more specific and detailed description of the invention summarized above will be rendered by reference to the accompanying drawings. It is to be understood that these drawings provide only selected embodiments of the invention and are not therefore to be considered limiting of its scope. Also, the skilled artisan would understand that the invention can be practiced without employing these specific details. Indeed, the spirit of the invention can still be practiced while modifying the illustrated instruments. With reference to FIG. 1A, an ocarina 1 comprises a hollow body 10 which includes an airway 11 for directing an air stream against a voicing 12, thereby generating the sound of the instrument. The ocarina 1 includes a plurality of toneholes 100 that are stopped or unstopped to alter the pitches the instrument produces. The embodiment of a cross-fingered ocarina depicted includes a split tonehole 101 that, when stopped, performs the normal function of the second smallest tonehole of typical cross-fingered ocarinas. The second smallest tonehole common in prior art must be replaced with the split tonehole 101 to achieve the improvement found in the embodiment. The smaller of the holes that make up the split tonehole 101 is sized to alter the pitch of the instrument by one semitone when performing any pitch within four semitones above the tonic. Thereby the user may perform the pitch one semitone above the tonic by unstopping the smaller hole of the split tonehole 101, and also may perform the pitch three semitones above the tonic by unstopping the smaller hole of the split tonehole 101 and the smallest of the standard toneholes 100. In this manner the performer overcomes the inability of cross-fingered ocarinas of the prior art using a split tonehole to provide an accurate means of performing three semitones above the tonic.

As depicted, a cross-fingered ocarina may also feature thumbholes 102 which may include an enlarged thumbhole 102*b* that is used to raise the pitch by three semitones, as opposed to the customary two semitones. The fingering pattern is altered accordingly.

Figure 1B:
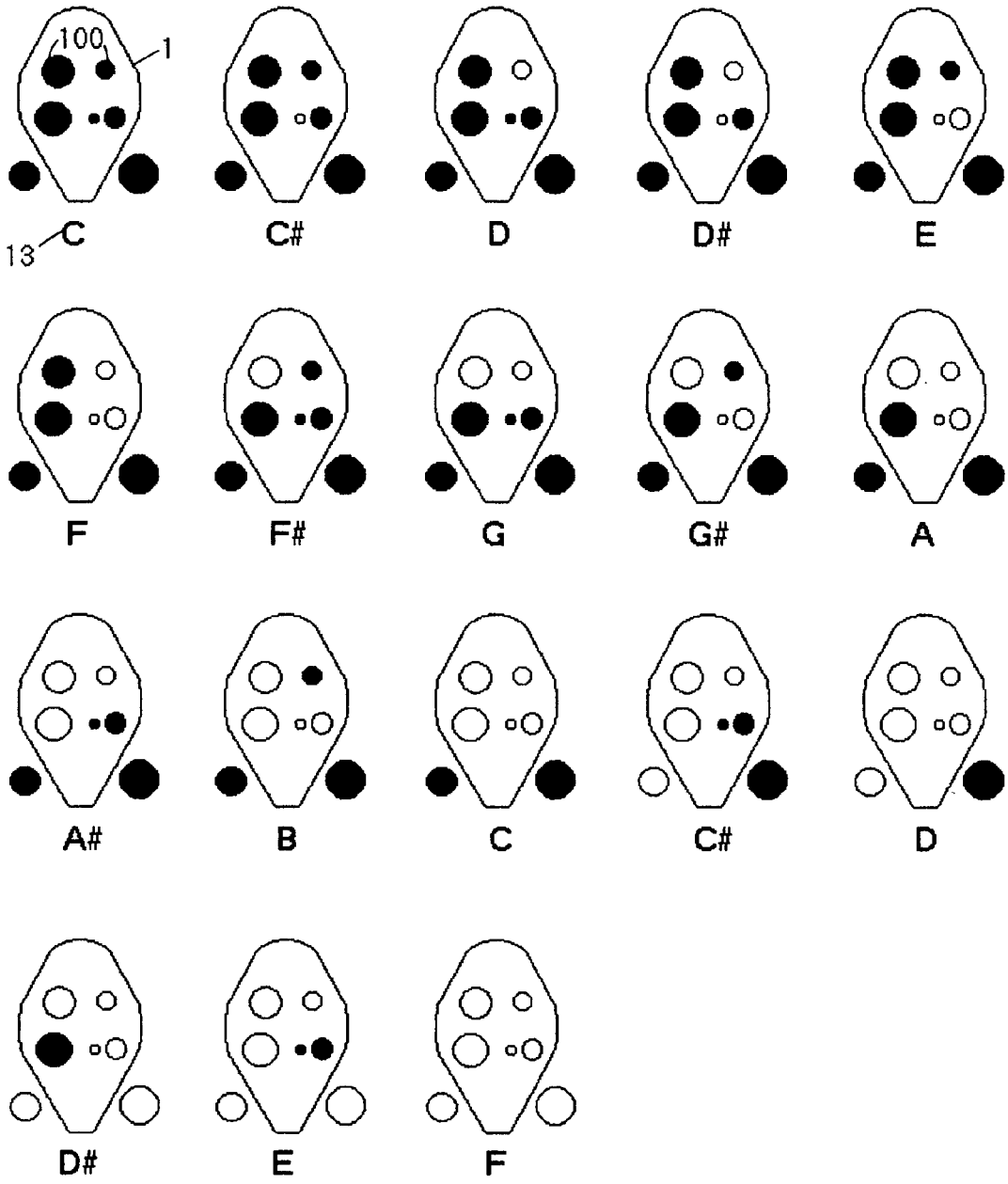
FIG. 1B is a fingering chart of the ocarina depicted in FIG. 1A.

By reference to FIG. 1B, a fingering chart, a clear understanding of the use of toneholes of an ocarina of the embodiment is rendered. On each representation of the ocarina 1 are representations of toneholes 100. Stopped toneholes 100 are shown filled in black and unstopped toneholes 100 are shown unfilled. Representations of thumbholes 102, 102*b* are depicted adjacent to each representation of the ocarina 1. Below each representation of the ocarina is printed the pitch 13 produced according to which toneholes 100 are stopped or unstopped if the tonic note is the note "C". The tonic may actually be any note.

Figure 2A:
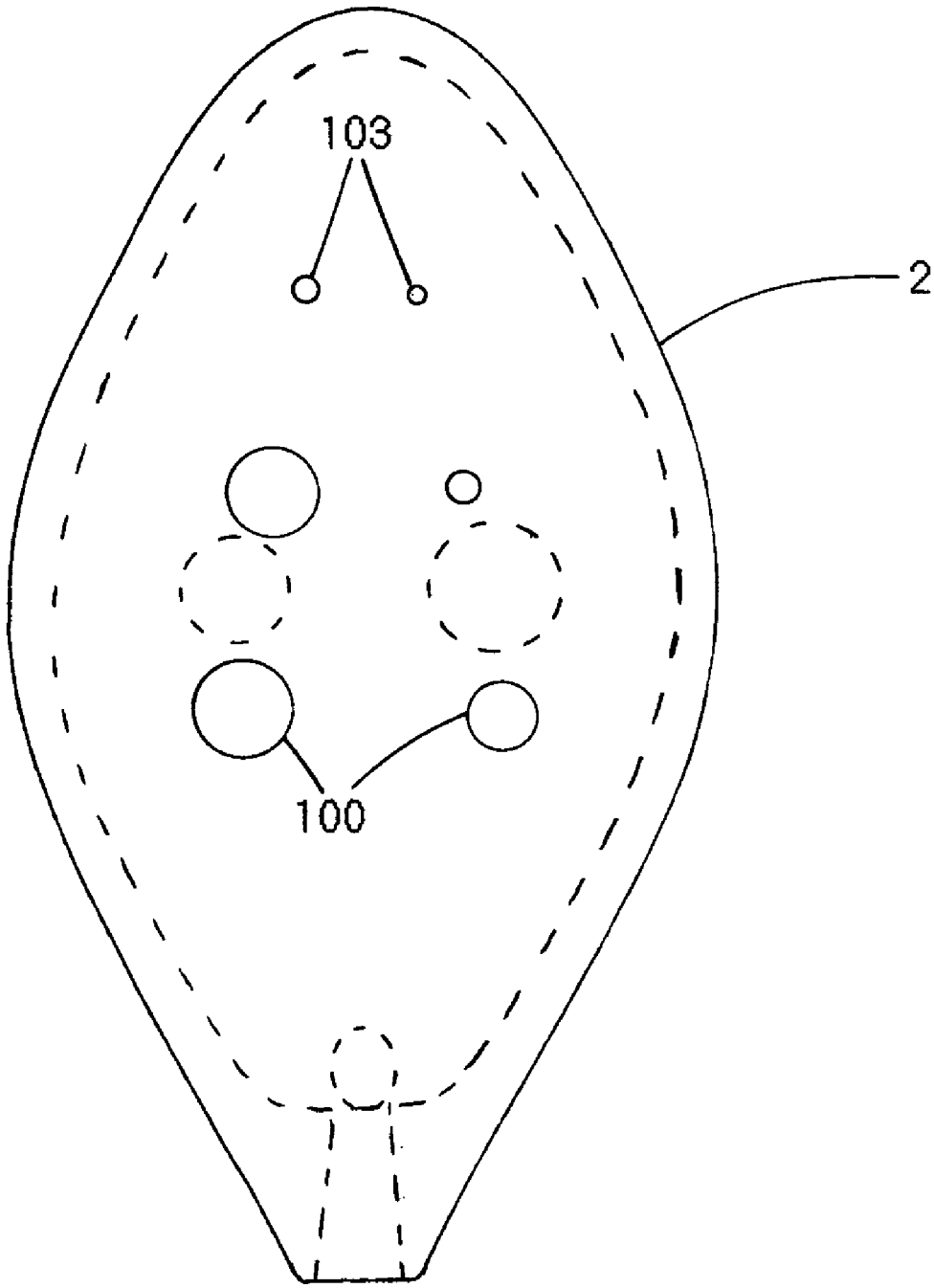
FIG. 2A is an elevation view of a cross-fingered ocarina according to the invention.
Figure 2B:
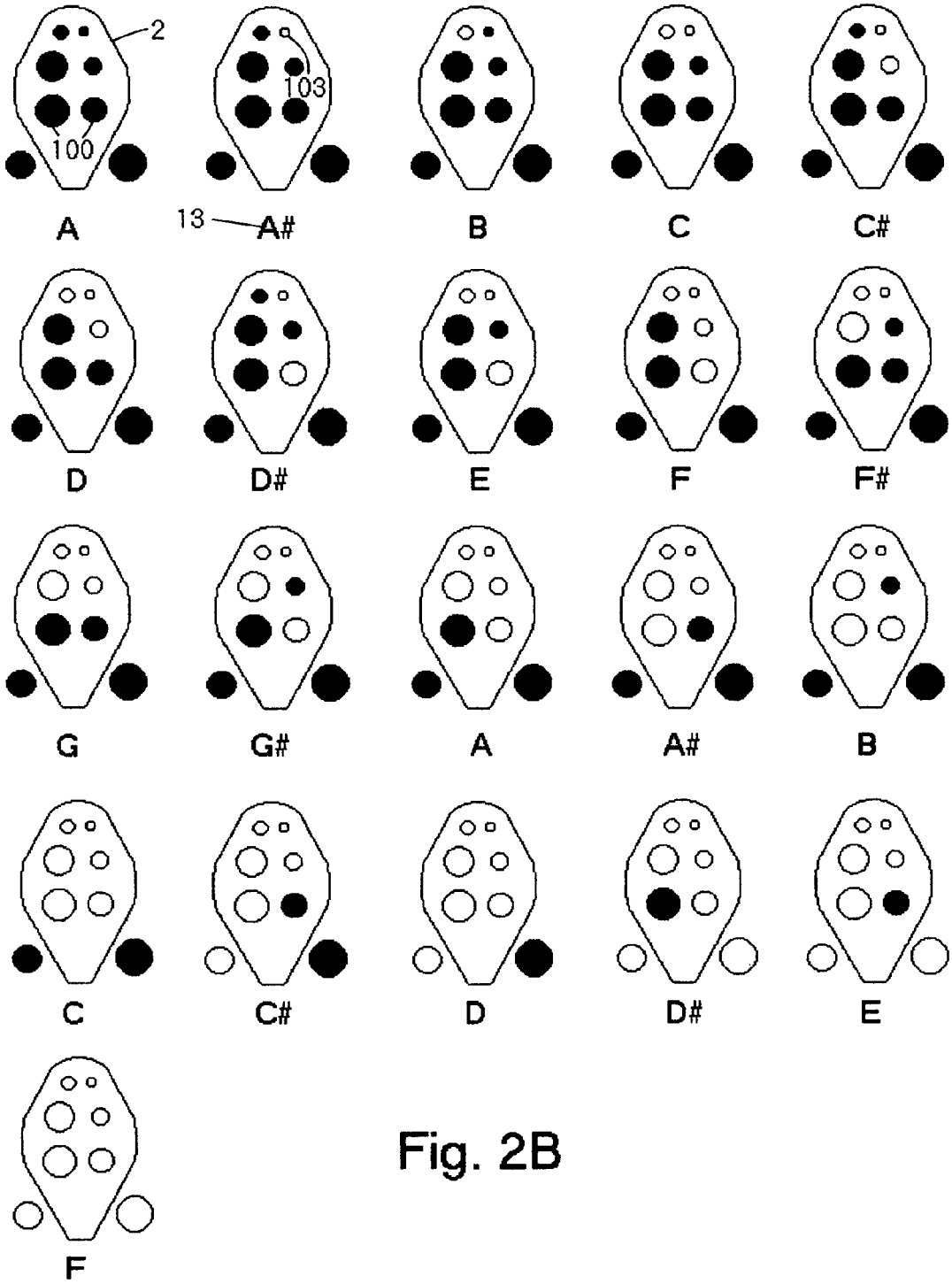
FIG. 2B is a fingering chart of the ocarina depicted in FIG. 2A.

Referring to FIG. 2A, an ocarina 2 according an embodiment of the invention adds at least one, but preferably two, subholes 103 to an otherwise standard cross-fingering. The subholes 103 are not adjacent to the other toneholes 100, but are arranged to be stopped by fingers other than those used to operate the other toneholes 100, preferably the ring fingers. This allows for performance of all accidentals with greater ease than the prior art and as well as additional advantages. Since the subholes 103 are not adjacent to other toneholes 100 as they are in all prior art, they may more easily be utilized to perform trills, aid in performing crescendos, or change the key of a small passage. The subholes 103 are similar to subholes common in linear-fingered ocarinas of the prior art in that they may be used to expand the range of the instrument and lower the pitch below the tonic note. However, the subholes 103 are different from all prior art in that the fingers dedicated to the subholes are not needed to operate other toneholes and are thus unencumbered. FIG. 2B is a fingering chart depicting how the subholes 103 and other toneholes 100 of an ocarina 2 of the embodiment may be used to perform its range of pitches 13. The tonic note may be any note, but in this example is the note "C".

Figure 3A:
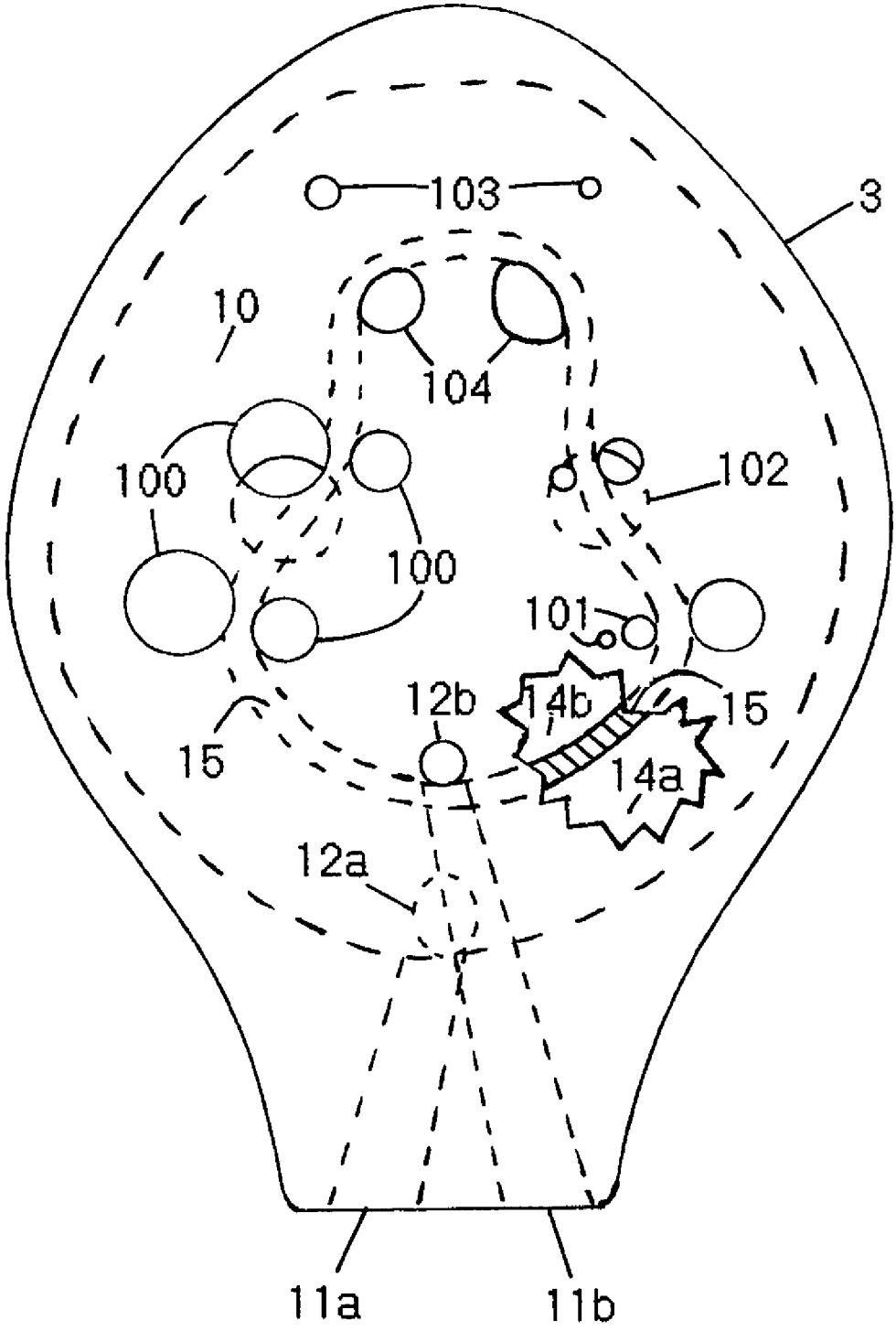
FIG. 3A is an elevation view of a two-chambered cross-fingered ocarina according to the invention.

FIG. 3A depicts a two-chambered cross-fingered ocarina 3 according to an embodiment of the invention. It includes a body 10, two airways 11*a* and 11*b*, and two voicings 12*a* and 12*b*, with the voicing 12*a* on the underside for a lower chamber 14*a*, meaning lower-pitched chamber, and the voicing 12*b* on the top for a higher chamber 14*b*, meaning higher-pitched chamber. The chambers 14*a* and 14*b* are both enclosed by the body 10. A wall or partition 15 that separates the two chambers 14*a* and 14*b* is visible in cross-section in a broken portion of the ocarina 3 and is represented by hidden lines where the partition 15 lies hidden beneath the body 10. In each chamber, the standard toneholes 100 of a cross-fingering are adjacent to the corresponding toneholes 100 of the other chamber. The two chambers 14*a* and 14*b* are used independently or simultaneously. The standard toneholes 100 can be used simultaneously to perform two corresponding notes at a one octave interval, or they may be fingered independently. Thumbholes 102 on the lower chamber 14*a* are optional but desirable. These aforementioned features of the embodiment depicted in FIG. 3A are common in the prior art. Novel features according to the embodiment are the addition of at least one, but preferably two, subholes 103 to the lower chamber 14*a* and two additional toneholes 104 to the higher chamber 14*b*. The subholes 103 function in like manner to those described in the embodiment according to FIG. 2A, and overcome the limitation of the prior art to permit accurate performance of accidentals in the lower range or notes below the tonic. The additional toneholes 104 to the higher chamber 14*b* function similarly to thumb-operated toneholes common in the prior art and overcome the limited range of one octave of the higher chamber of the prior art, such limitation being due to the impossibility of accessing the higher chamber with the thumbs. As an optional enhancement, the artisan may widen one of the additional toneholes 104 to increase the range by an additional semitone, in like manner to the enlarged thumbhole 102*b* described according to FIG. 1A.

The artisan is required to form the shape of the higher chamber 14*b* such that it can accommodate toneholes 100, 104 that may easily accommodate the performer's fingers. Typically, the shape is like a widened one half of a peanut shell or a dome roughly in the shape of the number eight. The higher chamber 14*b* may also include a split tonehole 101 as the second largest tonehole, like that described according to FIG. 1A, to allow the ocarina 3 to accurately perform all accidentals within the entire range.

Figure 3B:
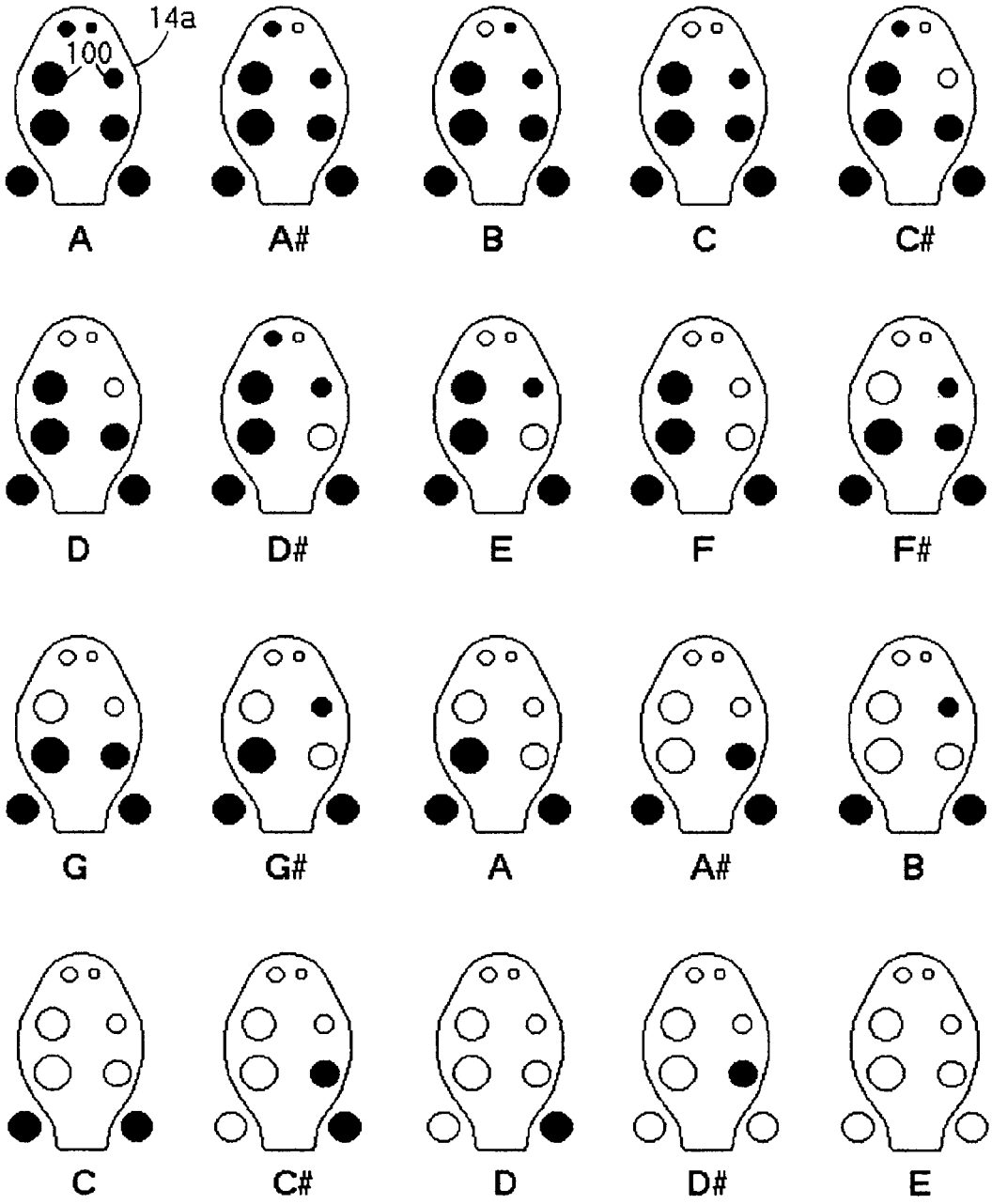
FIG. 3B is a fingering chart of the lower chamber of the ocarina depicted in FIG. 3A.
Figure 3C:
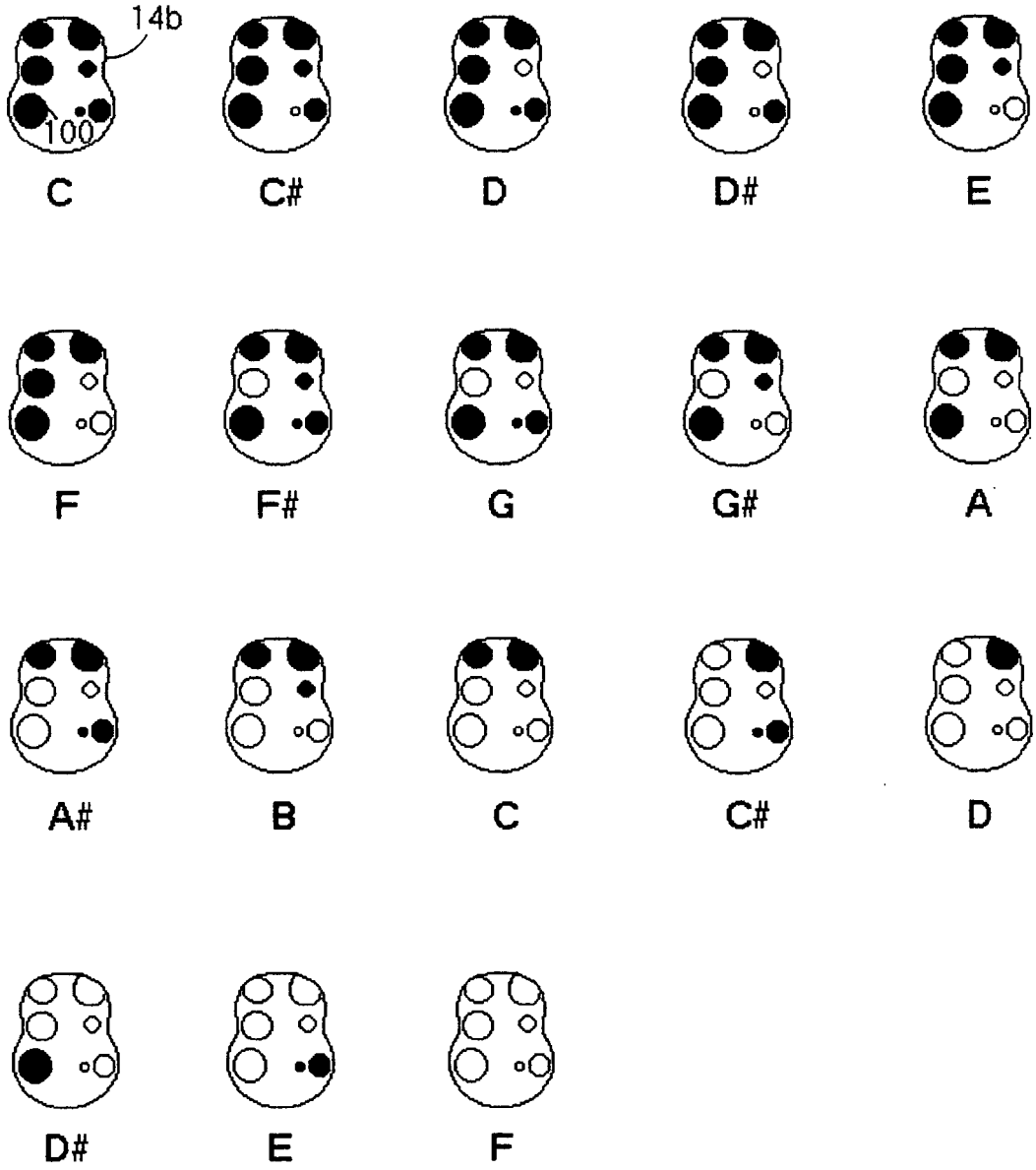
FIG. 3C is a fingering chart of the higher chamber of the ocarina depicted in FIG. 3A.

Reference to FIG. 3B will make clear the fingering of the toneholes 100 of the lower chamber 14*a*. Reference to FIG. 3C will make clear the fingering of the toneholes 100 of the higher chamber 14*b*. The tonic of an ocarina according to the embodiment of the invention depicted here is "C", but it may be any pitch.

Figure 4A:
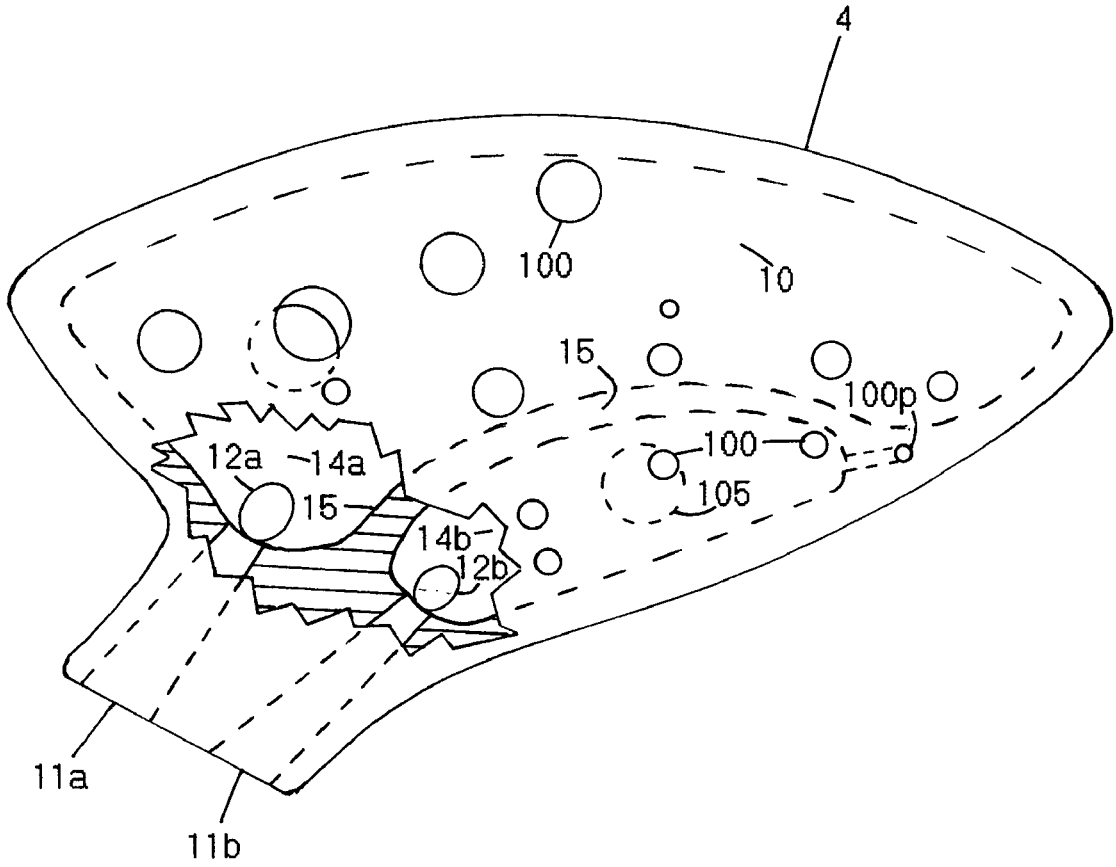
FIG. 4A is an elevation view of a two-chambered linear-patterned ocarina according to the invention.

Referring to FIG. 4A, a two-chambered linear-fingered ocarina 4 according to an embodiment of the invention is depicted. It includes two airways 11*a* and 11*b*, two voicings 12*a* and 12*b*, a lower chamber 14*a*, a higher chamber 14*b*, and a body 10 that encloses the chambers 14*a* and 14*b*. A wall or partition 15 separating the two chambers is also visible in cross-section in a broken portion of the ocarina 4 and is represented by hidden lines where the partition 15 is hidden beneath the body 10. The toneholes 100 of the lower chamber 14*a* are the same that are common in the prior art. However, the higher chamber 14*b* and its accompanying toneholes 100 have novel functions that enhance the range of the chamber 14*b*. A large thumbhole 105 is added to what would otherwise be a typical fingering pattern for a higher chamber of a two chambered ocarina. After the toneholes 100 of the top of the ocarina 4 are all unstopped, the performer unstops the large thumbhole 105, and then uses the other toneholes 100 in a novel pattern to perform at least five additional semitones, these pitches all being above the highest pitch of a typical two-chambered ocarina.

A fingering pattern like the one according to the embodiment is not possible to add to ocarinas of the prior art. All linear-patterned two-chambered ocarinas of the prior art have higher chambers that are substantially tube-like in shape. Accordingly, not only is there insufficient space to accommodate a large thumbhole, but also a tonehole, whether for the thumb or another finger, large enough to expand the range would adversely affect the properties of the chamber to the extent that it would nullify the correct operation of the entire chamber, or, in other words, the notes would not play after the thumbhole is unstopped. Furthermore, a tube-like chamber is so lengthy that the fundamental pitch of the chamber must be well below the desired lowest-pitched note for the chamber. In compensation for this, and to compensate for weak volume or blowing strength of such chambers, a hole or holes are added to raise the pitch and let air escape. Since each chamber is limited in range, especially a higher chamber that requires greater blowing strength, a chamber whose fundamental pitch is many semitones below the desired lowest-pitched note cannot adequately perform above what is standard in the prior art.

The higher chamber 14*b* according to the embodiment depicted is not tube-like. It preferably has a shape similar to a shelled brazil nut, with the widest portion thereof positioned toward the airway 11*b*. The higher chamber's 14*b* rounder shape has several advantages. The shortened length raises the fundamental pitch to the desired lowest pitch to be performed or near to it. Furthermore, the vessel-like shape typically results in a stronger, more sonorous sound. These two advantages may remove the need for additional tuning holes to allow air to escape for tuning or dynamic purposes. However, a small tuning hole or holes, not depicted, may be included if desired. A further advantage of the shape of the higher chamber 14*b* is that it is sufficiently wide and tall that the presence of a large tonehole, for example, a large thumbhole 105 that raises the pitch by several tones, does not adversely affect the operation of the chamber 14*b* and the other toneholes 100. Accordingly, a higher chamber 14*b* according to the embodiment in conjunction with an improved fingering enables the higher chamber 14*b* to equal or exceed capabilities of both a second and third chamber of ocarinas of the prior art.

In order to achieve the improved shape of the higher chamber 14*b*, the pinky finger tonehole 100*p* typically must be angled toward the higher chamber 14*b* from its outlet on the surface of the body 10 of the ocarina 4. This method of angling the tonehole 100*p* is depicted by hidden lines. Also, placing the pinky finger tonehole 100*p* substantially near the side surface of the ocarina 4 as opposed to the top will allow the user to partially tuck the pinky finger under the ring finger in an ergonomic manner to cover the pinky finger tonehole 100*p*. It is usually important to make a depression or indentation where the pinky is to be placed, both for comfort and so that the pinky finger tonehole 100*p* may properly be sealed. The artisan should take into account the need to give the user's fingers sufficient space and to distance toneholes 100 from the voicing 12 as much as possible.

Figure 4B:
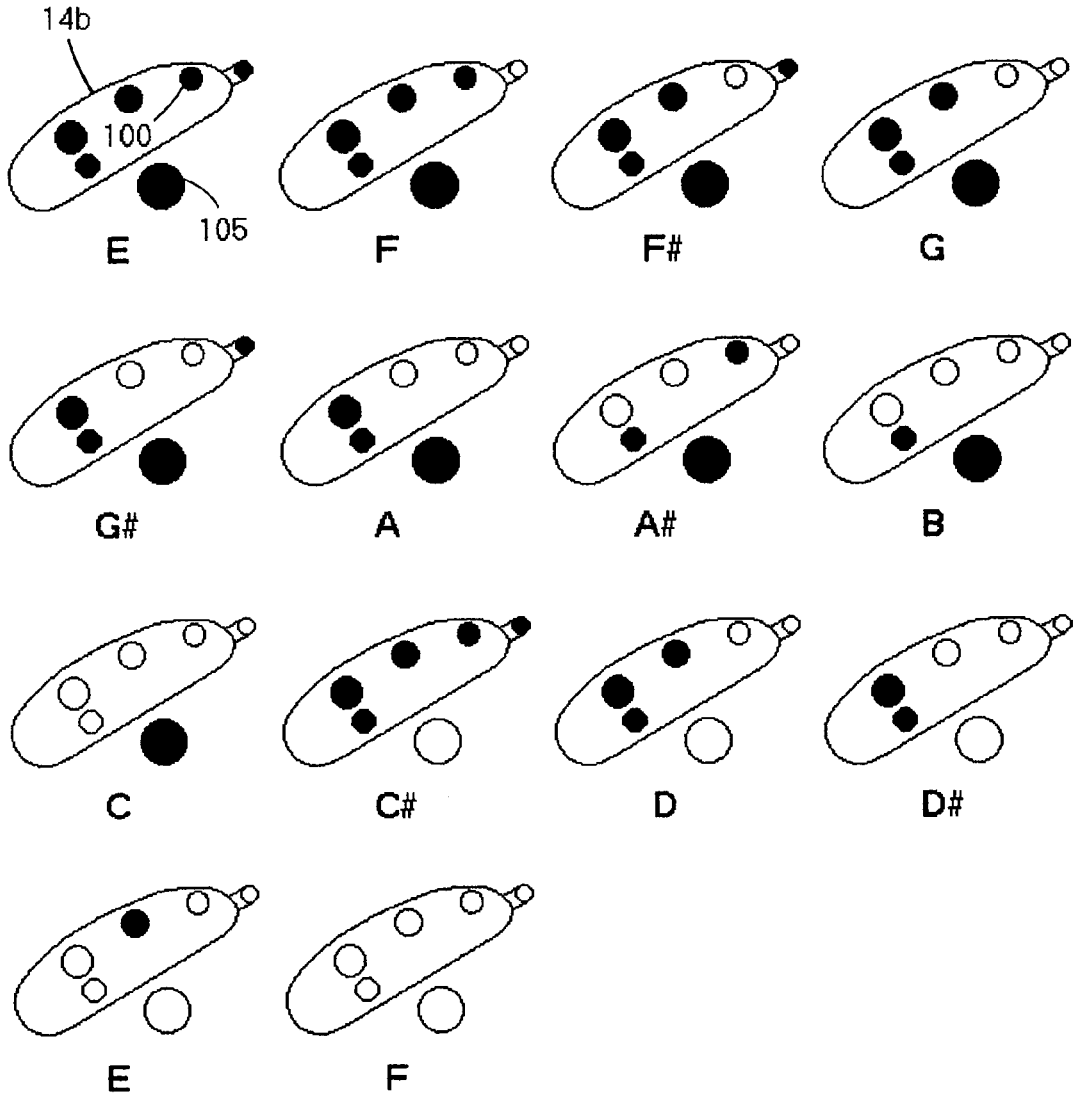
FIG. 4B is a fingering chart of the higher chamber of the ocarina depicted in FIG. 4A.

The fingering method for the lower chamber 14*a* of the embodiment is common in the prior art and is therefore not depicted. The manner of performing the pitches of the higher chamber 14*b* of the embodiment is depicted in FIG. 4B. The large thumbhole 105 is depicted adjacent to each representation of the chamber 14*b*. The toneholes 100 are depicted within each representation of the chamber 14*b*.

Figure 5A:
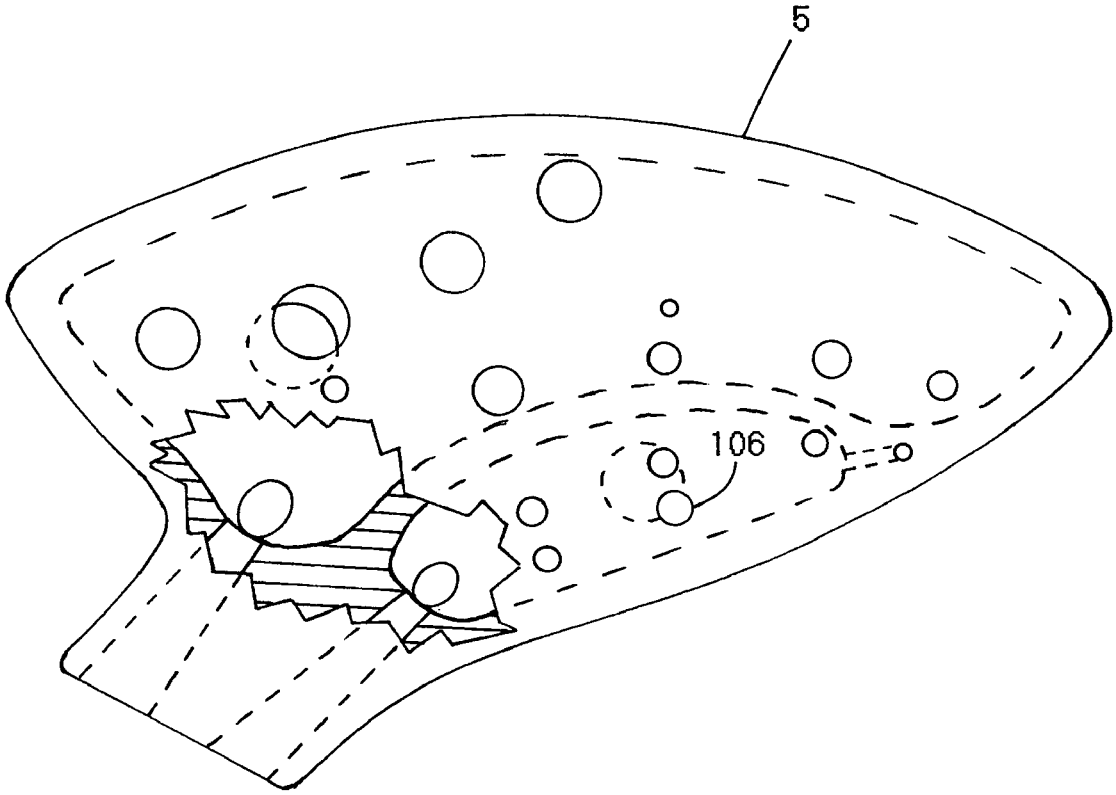
FIG. 5A is an elevation view of a two-chambered linear-patterned ocarina according to the invention.
Figure 5B:
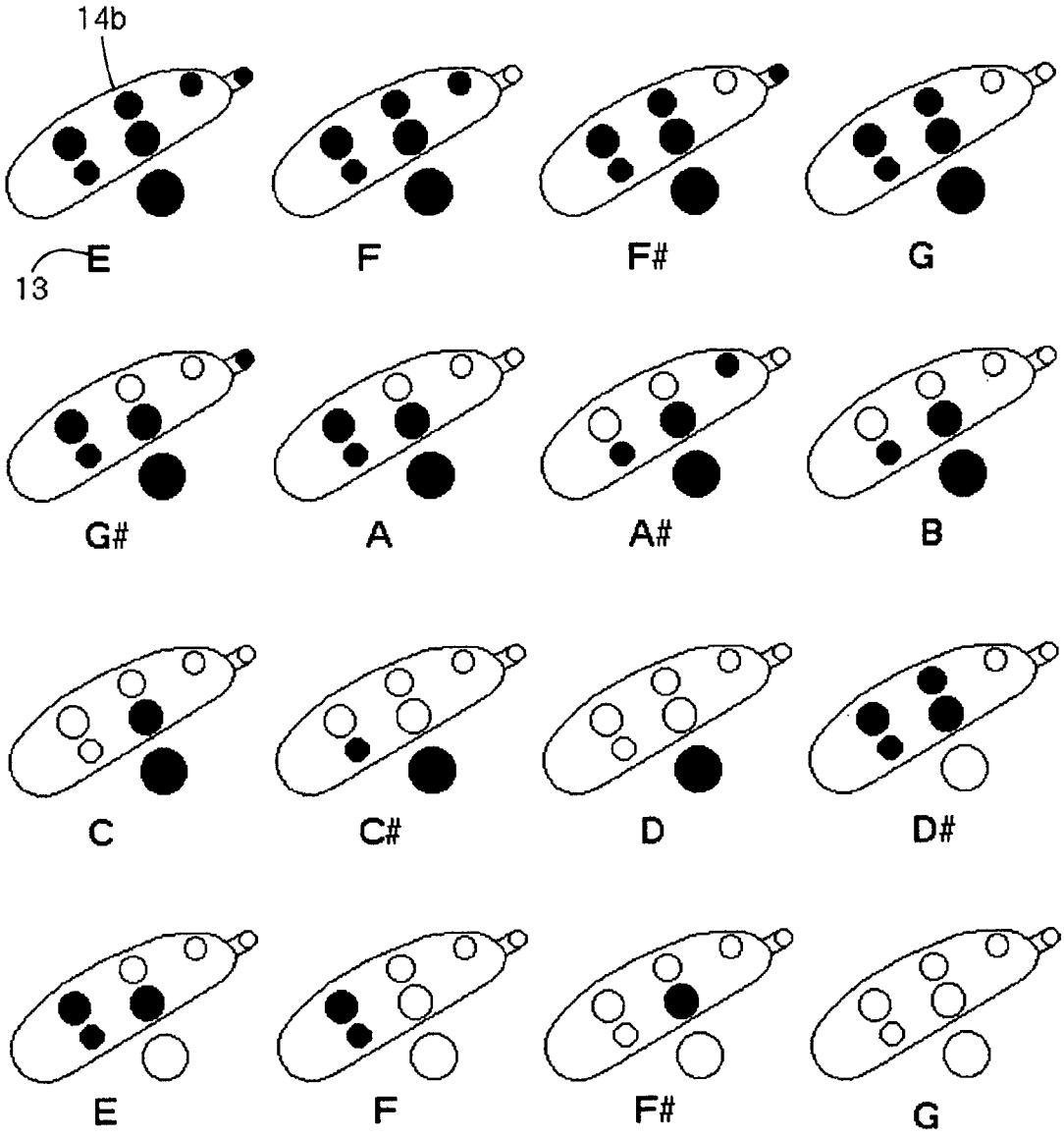
FIG. 5B is a fingering chart of the higher chamber of the ocarina depicted in FIG. 5A.

Referring to FIG. 5A, the two-chambered linear-patterned ocarina 5 depicted is identical to the ocarina depicted in FIG. 4A, with one exception. In FIG. 5A, an additional tonehole 106 has been added to the chamber to achieve a highest note two semitones above the highest note capable with the ocarina of FIG. 4A. FIG. 5B depicts the fingering pattern the performer would use to ascend the pitches 13 of the higher chamber 14*b* of the embodiment to the highest possible pitch. With practice and skill the artisan, by using a large thumbhole in the higher chamber of a two-chambered linear-patterned ocarina, may possibly achieve a range even beyond that of the ocarina of FIG. 5A.

Figure 6A:
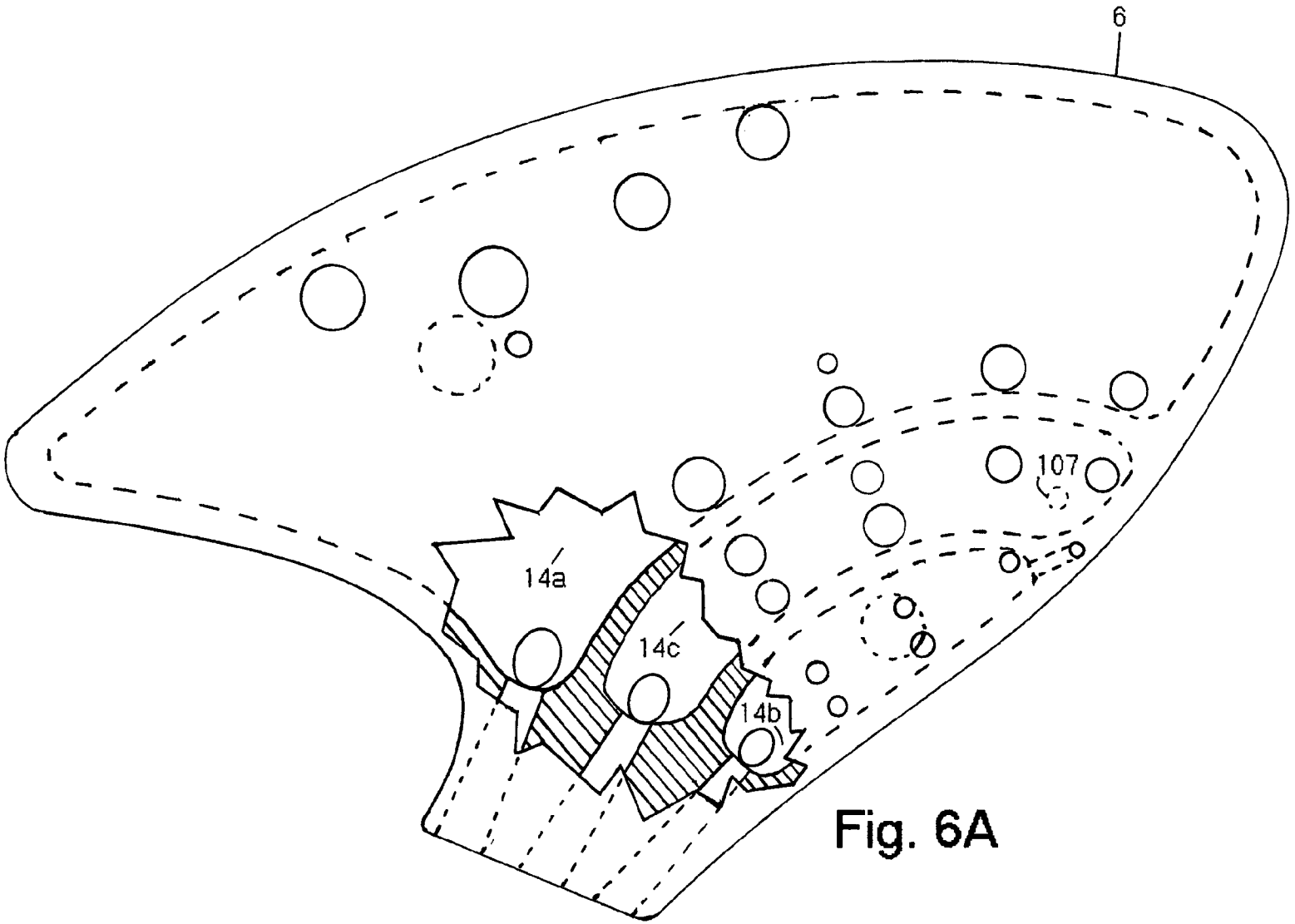
FIG. 6A is an elevation view of a three-chambered linear-patterned ocarina according to the invention.
Figure 6B:
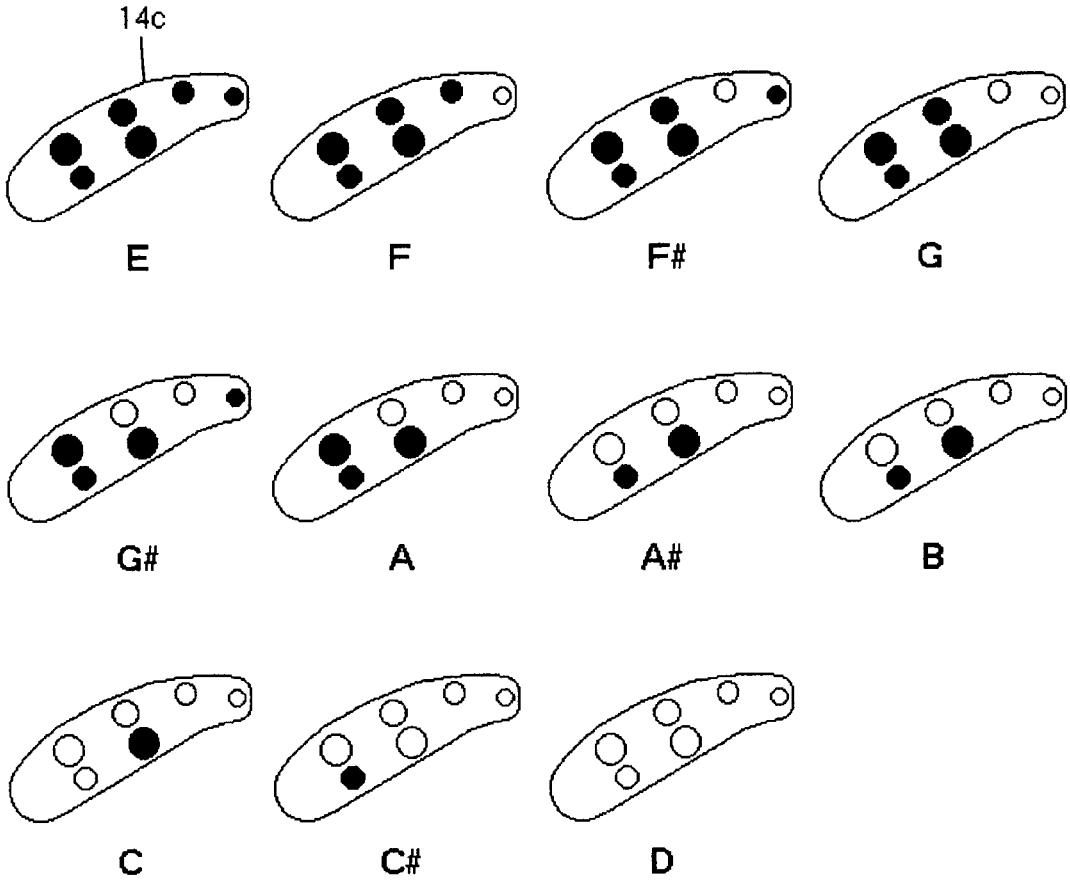
FIG. 6B is a fingering chart of the middle chamber of the ocarina depicted in FIG. 6A

Referring to FIG. 6A, a three-chambered linear-patterned ocarina 6 according to the embodiment is depicted. The lowest chamber 14*a* preferably has a layout and fingering pattern very similar to the lower chamber of a typical two-chambered ocarina with the exception that the notes to be performed are typically one octave below the normal range. The highest chamber 14*b* of the embodiment is typically identical to the higher chamber of the ocarinas depicted in FIG. 4A or 5A, here depicted identical to the higher chamber of the ocarina of FIG. 5A. The middle chamber 14*c* of the embodiment preferably is pitched near the upper range of the lowest chamber 14*a* of the embodiment, the middle chamber's 14*c* lowest performable note being tuned to one semitone above the highest performable note of the lowest chamber 14*a*. An optional tuning hole 107 helps balance the strength of air required by the performer to properly perform the lowest-pitched note, that the blowing strength required may be very similar to that required to properly perform the highest note of the lowest chamber 14*a*. The performer utilizes a modified linear fingering pattern for the middle chamber, like that depicted in FIG. 6B, to perform the pitches of the chamber 14*c* up to the highest. The highest performable pitch of the middle chamber 14*c* is the lowest performable pitch of the highest chamber 14*b*.

Constructing an ocarina 6 according to the embodiment enables the skilled artisan to provide an instrument capable of performing four octaves of notes, which is about one octave greater than three-chambered ocarinas of the prior art.

Figure 7A:
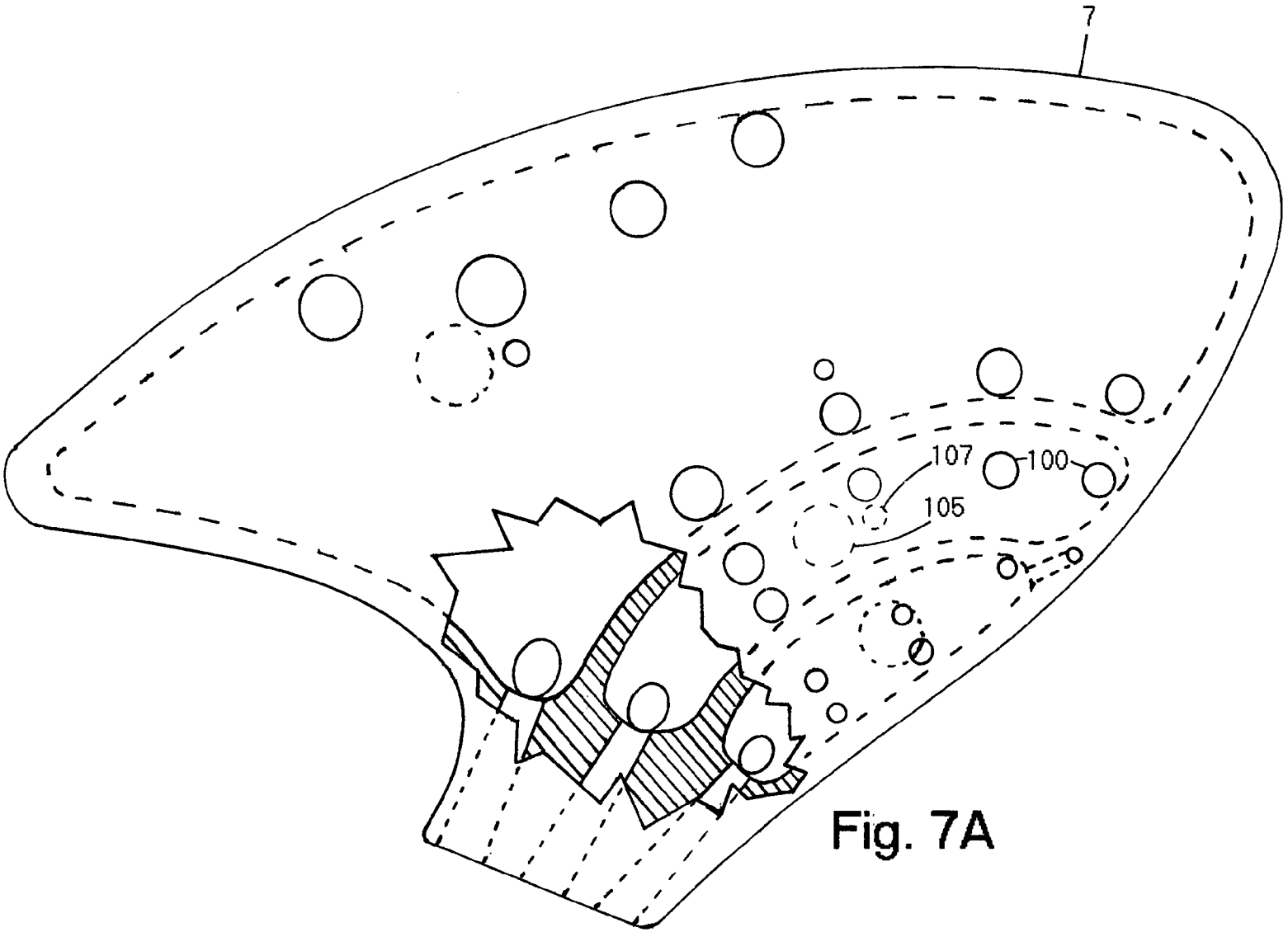
FIG. 7A is an elevation view of a three-chambered linear-patterned ocarina according to the invention.
Figure 7B:
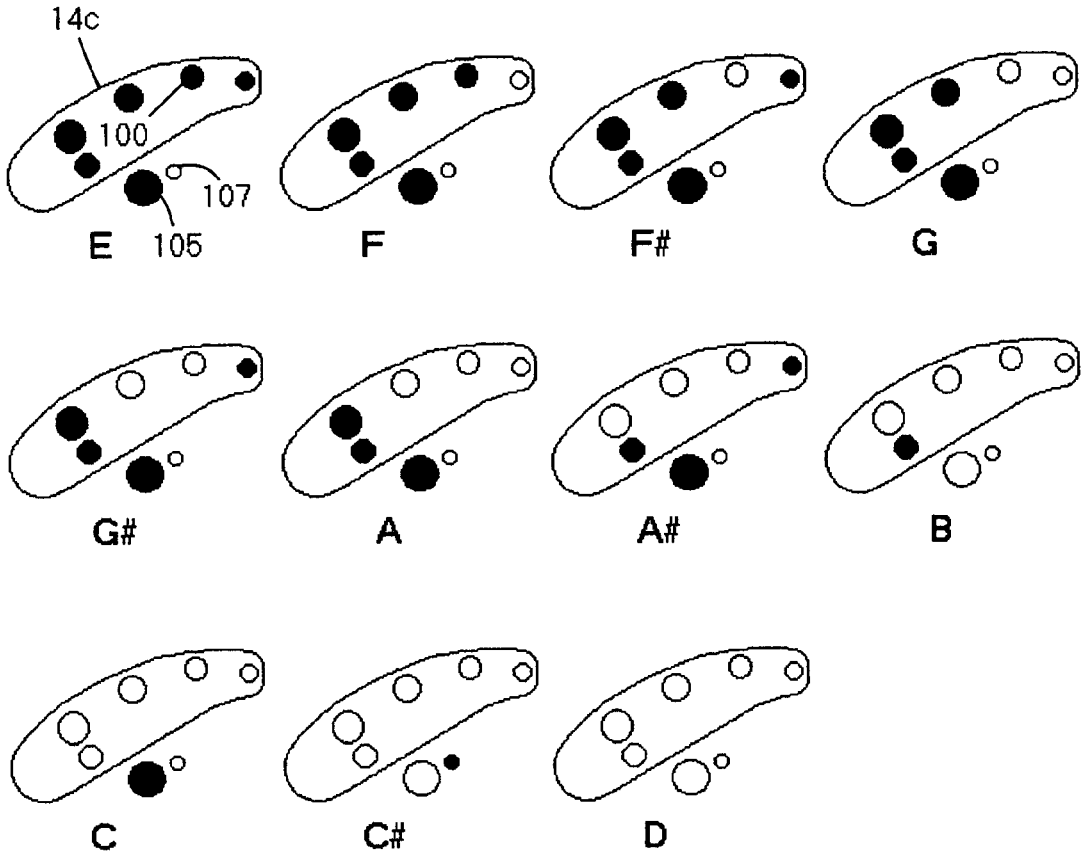
FIG. 7B is a fingering chart of the middle chamber of the ocarina depicted in FIG. 7A
Figure 7C:
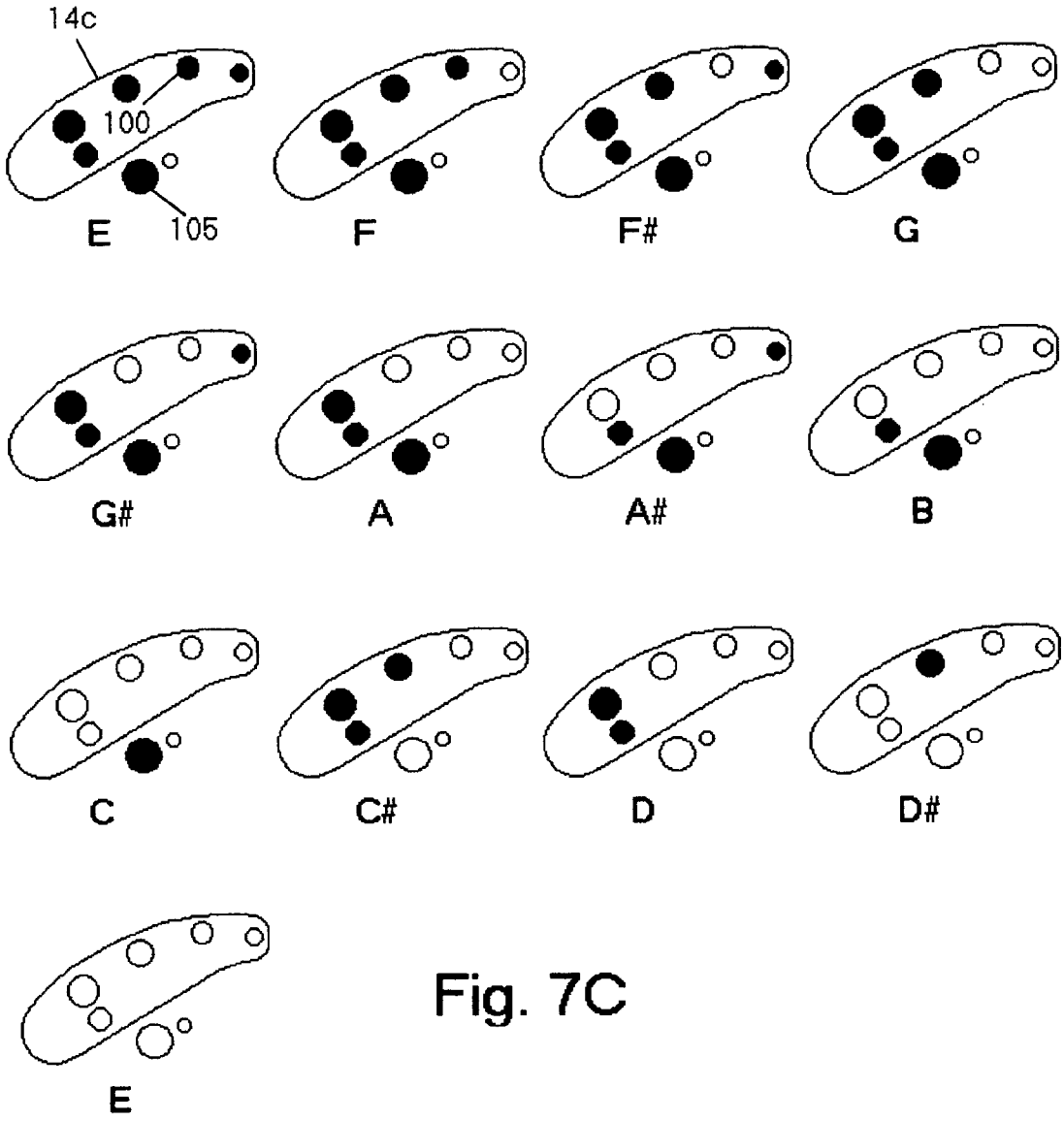
FIG. 7C is a fingering chart of the middle chamber of a variation of the ocarina depicted in FIG. 7A.

Referring to FIG. 7A, the three-chambered linear-patterned ocarina 7 depicted is identical to the ocarina depicted in FIG. 6A, with two exceptions: In FIG. 7A, one of the toneholes 100 on top of the instrument has been removed and has been replaced with a large thumbhole 105 on the bottom of the ocarina 7 and the tuning hole has been moved. Since a performer's thumb is able to seal a larger hole than the performer's other fingers, a large thumbhole 105 can be made large enough to allow the performance of additional pitches. Depending on the size of the large thumbhole 105 and the fingering pattern desired, the tuning hole 107 may also be incorporated into the fingering pattern. Providing additional notes in the middle chamber adds the benefit of allowing the performer to optionally perform some of the same notes on both the middle chamber and the higher chamber, which will reduce the need to switch between chambers. FIG. 7B depicts a fingering pattern of the middle chamber 14*c* where the toneholes 100, tuning hole 107, and the large thumbhole 105 are used to perform pitches as labled. FIG. 7C depicts a fingering pattern of the middle chamber 14*c* where only the toneholes 100 and large thumbhole 105 are used to perform pitches as labled.

While the above description contains many specificities, these should not be construed as limitations on the scope of the invention, but as exemplifications of the selected embodiments thereof. Many other ramifications and variations are possible within the teachings of the invention. Thus the scope of the invention should be determined by the appended claims and their legal equivalents, and not by the examples given.

I claim:

1. An ocarina comprising a) a body enclosing a hollow chamber;

b) a voicing for creating sound when air is directed against said voicing;

c) an airway for directing air against said voicing;

d) four toneholes positioned in said body to be stopped by the index and middle fingers of a performer such that the unstopping of said toneholes will produce a one octave major scale; and e) at least one subhole positioned in said body to be stopped by at least one ring finger or at least one pinky finger of the performer such that when said four toneholes are stopped the stopping of said at least one subhole will produce at least one tone below said one octave major scale.

2. The ocarina of claim 1, wherein said at least one subhole comprises two said subholes.

3. The ocarina of claim 1, further comprising at least one thumbhole.

4. An ocarina comprising:

a) a body enclosing a larger hollow chamber and a smaller hollow chamber;

b) two voicings for creating sound when air is directed against said two voicings;

c) two airways for directing air against said two voicings;

d) first four toneholes positioned in said body above said larger hollow chamber to be stopped by the index and middle fingers of a performer such that the unstopping of said first four toneholes will produce a first one octave major scale;

e) second four toneholes positioned in said body above said smaller hollow chamber to be stopped by the index and middle fingers of the performer such that the upstopping of said second four toneholes will produce a second one octave major scale; and f) at least one additional tonehole positioned in said body above said smaller hollow chamber to be stopped by at least one ring finger of the performer such that when said second four toneholes are unstopped the unstopping of said at least one additional tonehole will produce at least one tone above said second one octave major scale.

5. The ocarina of claim 4, wherein said at least one additional tonehole comprises two said additional toneholes.

6. The ocarina of claim 4, further comprising at least one subhole positioned in said body above said larger hollow chamber to be stopped by at least one pinky finger of the performer such that when said first four toneholes are stopped the stopping of said at least one subhole will produce a tone below said first one octave scale.

7. An ocarina comprising:

a) a body enclosing at least two hollow chambers including a larger hollow chamber and a smaller hollow chamber;

b) at least two voicings for creating sound when air is directed against said at least two voicings;

c) at least two airways for directing air against said at least two voicings;

d) a first plurality of toneholes positioned in said body above said larger hollow chamber;

e) a second plurality of toneholes positioned in said body above smaller hollow chamber; and f) at least one thumbhole positioned in said body below said smaller hollow chamber to be stopped by one thumb of a performer such that when said second plurality of toneholes are unstopped the unstopping of said at least one thumbhole will raise the produced tone by at least four semitones.

8. The ocarina of claim 7, wherein said at least two hollow chambers comprise two said hollow chambers and said at least one thumbhole comprises one said thumbhole.

9. The ocarina of claim 7, further comprising a third hollow chamber positioned between said larger hollow chamber and said smaller hollow chamber and a third plurality of toneholes positioned in said body above said third hollow chamber.

10. The ocarina of claim 9, further comprising a thumbhole positioned in said body below said third hollow chamber.

* * * * *